US010526113B2

(12) United States Patent
Toh

(10) Patent No.: US 10,526,113 B2
(45) Date of Patent: Jan. 7, 2020

(54) CONTAINER CLOSURE AND PREFORM

(71) Applicant: Colgate-Palmolive Company, New York, NY (US)

(72) Inventor: Kiat-Cheong Toh, Forest Hills, NY (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 15/746,845

(22) PCT Filed: Jul. 23, 2015

(86) PCT No.: PCT/US2015/041753
§ 371 (c)(1),
(2) Date: Jan. 23, 2018

(87) PCT Pub. No.: WO2017/014787
PCT Pub. Date: Jan. 26, 2017

(65) Prior Publication Data

US 2018/0215512 A1 Aug. 2, 2018

(51) Int. Cl.
*B65D 41/17* (2006.01)
*B65D 41/08* (2006.01)
*B65D 1/02* (2006.01)

(52) U.S. Cl.
CPC ..... *B65D 41/17* (2013.01); *B65D 1/0246* (2013.01); *B65D 2501/0081* (2013.01)

(58) Field of Classification Search
CPC ..... B65D 41/17; B65D 41/18; B65D 41/46; B65D 41/47; B65D 41/48; B65D 1/0246;
(Continued)

(56) References Cited

U.S. PATENT DOCUMENTS 1,459,589 A * 6/1923 Hoffman ..... B65D 41/04 215/318
1,977,589 A * 10/1934 Merolle ..... B65D 41/06 215/330

(Continued)

FOREIGN PATENT DOCUMENTS

CH 620649 A * 12/1980
CN 2637370 9/2004

(Continued)

OTHER PUBLICATIONS

Author Unknown, "Draft (engineering)", Wikipedia, http://en.wikipedia.org/wiki/Draft_(engineering), accessed Jun. 27, 2015, pp. 1-2.

(Continued)

*Primary Examiner* — Robert J Hicks

(57) ABSTRACT

A container closure system comprises a container 100 comprising a neck 120 having an outer surface, the neck including a plurality of snap ring segments 140 alternating with a plurality of snap ring voids 160 positioned around a circumference of the outer surface. The length of the circumference at which snap ring voids exist is 25% or more of the total length of the circumference. The plurality of snap ring segments is positioned at regular increments around a circumference of the outer surface. The system further includes a cap 14 comprising, among other things, a base 26 that comprises a plurality of snap prongs 16 arranged so as to engage and disengage the plurality of snap ring segments when the cap is rotated on the neck of the container. The plurality of snap prongs are configured to hold the cap on or release the cap from the container.

12 Claims, 11 Drawing Sheets

(58) Field of Classification Search

CPC ..... B65D 1/023; B65D 1/0223; B65D 47/08; B65D 47/06; B65D 50/061; B65D 50/06; B65D 50/045; B65D 50/046; B65D 45/18; B65D 45/24; B65D 55/16; B65D 51/04; B65D 51/18; B65D 43/169; B65D 43/164; B65D 43/16

USPC ..... 215/225, 224, 43, 216, 317, 316, 318, 215/287, 280, 273, 45, 331, 330, 329, 215/243, 245, 244, 237; 220/326, 324, 220/319, 315, 298, 302, 301, 293, 300, 220/254.3, 254.1, 259.1, 256.1, 836, 810, 220/784, 788

See application file for complete search history.

(56) References Cited

U.S. PATENT DOCUMENTS

| | | | | |
|---|---|---|---|---|
| 3,860,152 | A * | 1/1975 | Marti | B65D 25/42 215/224 |
| 4,298,129 | A | 11/1981 | Stull | |
| 4,335,824 | A * | 6/1982 | Bush | B65D 50/067 215/224 |
| 5,143,235 | A * | 9/1992 | Repp | B65D 1/0246 215/256 |
| 5,292,017 | A | 3/1994 | Patterson | |
| 5,292,019 | A | 3/1994 | Patterson | |
| 5,927,529 | A * | 7/1999 | Hofmann | B65D 50/062 215/223 |
| 6,056,136 | A * | 5/2000 | Taber | B65D 51/145 215/252 |
| 6,321,923 | B1 * | 11/2001 | Wood | B65D 47/0809 16/225 |
| 6,439,412 | B2 | 8/2002 | Luch | |
| 8,365,933 | B2 | 2/2013 | Jaeckel | |
| 2002/0108924 | A1 | 8/2002 | White et al. | |
| 2011/0278253 | A1 | 11/2011 | Goodall | |
| 2012/0261378 | A1 * | 10/2012 | Acedo | B65D 41/06 215/216 |
| 2012/0267336 | A1 * | 10/2012 | Faragher | B65D 47/0838 215/224 |
| 2013/0270273 | A1 * | 10/2013 | Fox | B65D 47/0838 220/324 |

FOREIGN PATENT DOCUMENTS

| | | |
|---|---|---|
| DE | 102012100075 | 7/2013 |
| EP | 0909717 | 2/2003 |
| GB | 2063226 | 6/1981 |
| KR | 10-1282304 | 9/2011 |
| WO | WO 1993/021079 | 10/1993 |
| WO | WO 19970/35773 | 10/1997 |
| WO | WO 2009/009736 | 1/2009 |

OTHER PUBLICATIONS

International Search Report and Written Opinion of the International Searching Authority in International Application No. PCT/US2015/041753, dated Sep. 16, 2015.

* cited by examiner

CONTAINER CLOSURE AND PREFORM

BACKGROUND

Plastic blow molded bottles and the injection molded caps that snap onto them are designed for a secure fit that minimizes their chance of accidental separation during distribution and use. One example of such a bottle that is known for use as a container for shower gel is shown in FIGS. 1A and 1B. Bottle 10 includes a continuous snap ring 12 that extends a full 360°, without any voids, around a circumference of the neck. Snap ring 12 can be beveled on the top side so it functions like a barb for a cap to engage.

A snap-on cap 14 that can be used with bottle 10 of FIG. 1A is shown in FIGS. 2A, 2B and 2C. Cap 14 employs a four prong snap geometry that mates to the neck by slipping over snap ring 12. The prongs 16 are oriented 90° to each other and positioned to have an offset, $\alpha_1$, that is 45° from the part line 18 of the bottle (as measured from the midpoint of the prong), thus engaging the snap ring 12 on the neck in an intermittent manner at, for example, about where snap ring 12 intersects lines A, B, C and D, as shown in FIG. 1. One potential problem with this design is that it makes it difficult for the consumer to remove the cap if the bottle needs to be refilled.

Easy-off designs are known in the art for improving the ease with which a snap-on cap can be removed from a container. One example of such a design is shown in FIGS. 3A and 3B, which includes a bottle with six flower petal shaped tabs 30 positioned on the neck (three tabs on each side) and associated snaps 32 on the lid. A centering feature 34 aligns with gaps 36 in the lid. The centering feature 34 may provide leverage when twisting the cap that aids in removing the cap from the bottle. A similar flower petal design is employed in the conventional bottle and cap of FIGS. 4A and 4B.

FIGS. 5A and 5B show a conventional medicine bottle 10 that includes a snap ring 12 and an associated cap 14. The snap ring 12 extends nearly a full 360° around a circumference of the neck, with only a single void 13. Snap ring 12 can be beveled on the top side and functions like a barb for cap 14 to engage. Cap 14 employs a single snap 17 that mates to the neck by slipping over snap ring 12. The single snap 17 can be aligned with the void 13 to allow removal of the cap. This bottle and cap are designed to reduce the likelihood of accidental removal of the cap from the bottle 10, as the void is only about 5% or less of the total length of the circumference of the neck of the bottle.

The ability to refill bottles can potentially reduce waste production in the form of bottles disposed of by consumers. Thus, a novel bottle design that provides for ease of refilling the bottle would be a desired advancement in the art.

BRIEF SUMMARY

An embodiment of the present disclosure is directed a container closure system. The system comprises a container comprising a neck having an outer surface, the neck including a plurality of snap ring segments alternating with a plurality of snap ring voids positioned around a circumference of the outer surface. The length of the circumference at which snap ring voids exist is 25% or more of the total length of the circumference. The plurality of snap ring segments are positioned at regular increments around a circumference of the outer surface, the increments being measured from the midpoint of each of the snap ring segments on the circumference of the outer surface. The system further includes a cap comprising a skirt with an orifice positioned therein, a plug assembly for blocking and unblocking the orifice, and a base extending from the skirt and surrounding the orifice. The base comprises a plurality of snap prongs arranged so as to engage and disengage the plurality of snap ring segments when the cap is rotated on the neck of the container. The plurality of snap prongs are configured to hold the cap on the container when engaged with the plurality of snap ring segments and to release the cap from the container when the plurality of snap prongs are disengaged from the plurality of snap ring segments.

Another embodiment of the present disclosure is directed to a preform for use in a blow mold process. The preform comprises a plastic tube comprising a neck having an outer surface. The neck includes a plurality of snap ring segments alternating with a plurality of snap ring voids positioned around the outer surface. The length of the circumference at which snap ring voids exist is 25% or more of the total length of the circumference. The plurality of snap ring segments are positioned at regular increments around a circumference of the outer surface, the increments being measured from the midpoint of each of the snap ring segments on the circumference of the outer surface.

Yet another embodiment of the present disclosure is directed to a container closure system. The container closure system comprises a container comprising a neck having an outer surface, the neck including a plurality of snap ring segments alternating with a plurality of snap ring voids positioned around a circumference of the outer surface. The length of the circumference at which snap ring voids exist is about 60 to about 75% of the total length of the circumference. The system further includes a cap comprising a skirt with an orifice positioned therein, a plug assembly for blocking and unblocking the orifice, and a base extending from the skirt and surrounding the orifice. The base comprises a plurality of snap prongs arranged so as to engage and disengage the plurality of snap ring segments when the cap is rotated on the neck of the container. The plurality of snap prongs are configured to hold the cap on the container when engaged with the plurality of snap ring segments and to release the cap from the container when the plurality of snap prongs are disengaged from the plurality of snap ring segments.

Further areas of applicability of the present disclosure will become apparent from the detailed description provided hereinafter. It should be understood that the detailed description and specific examples, while indicating the preferred embodiment of the disclosure, are intended for purposes of illustration only and are not intended to limit the scope of the disclosure.

BRIEF DESCRIPTION OF THE DRAWINGS

The present invention will become more fully understood from the detailed description and the accompanying drawings, wherein.

DETAILED DESCRIPTION

The following description of the preferred embodiment(s) is merely exemplary in nature and is in no way intended to limit the disclosure, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

Figure 1A:
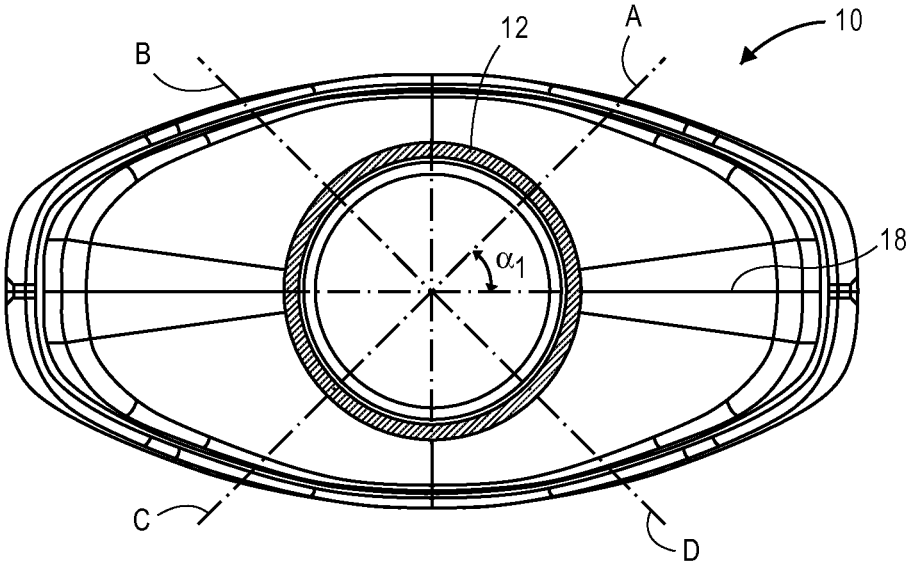
FIG. 1A (PRIOR ART)
FIG. 1A illustrates an overhead view of a conventional snap ring bottle.
Figure 1B:
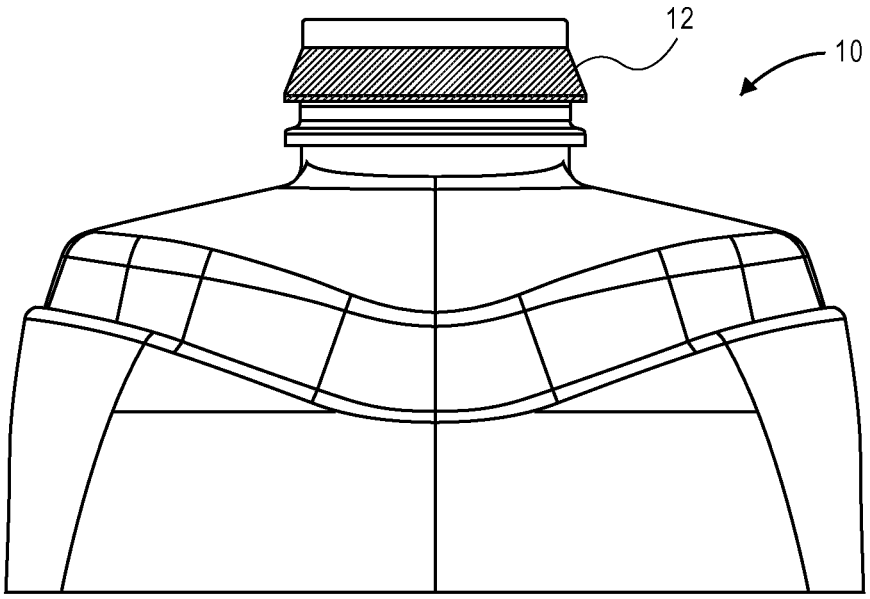
FIG. 1B (PRIOR ART)
FIG. 1B illustrates a side view of the conventional snap ring bottle of FIG. 1A.
Figure 2A:
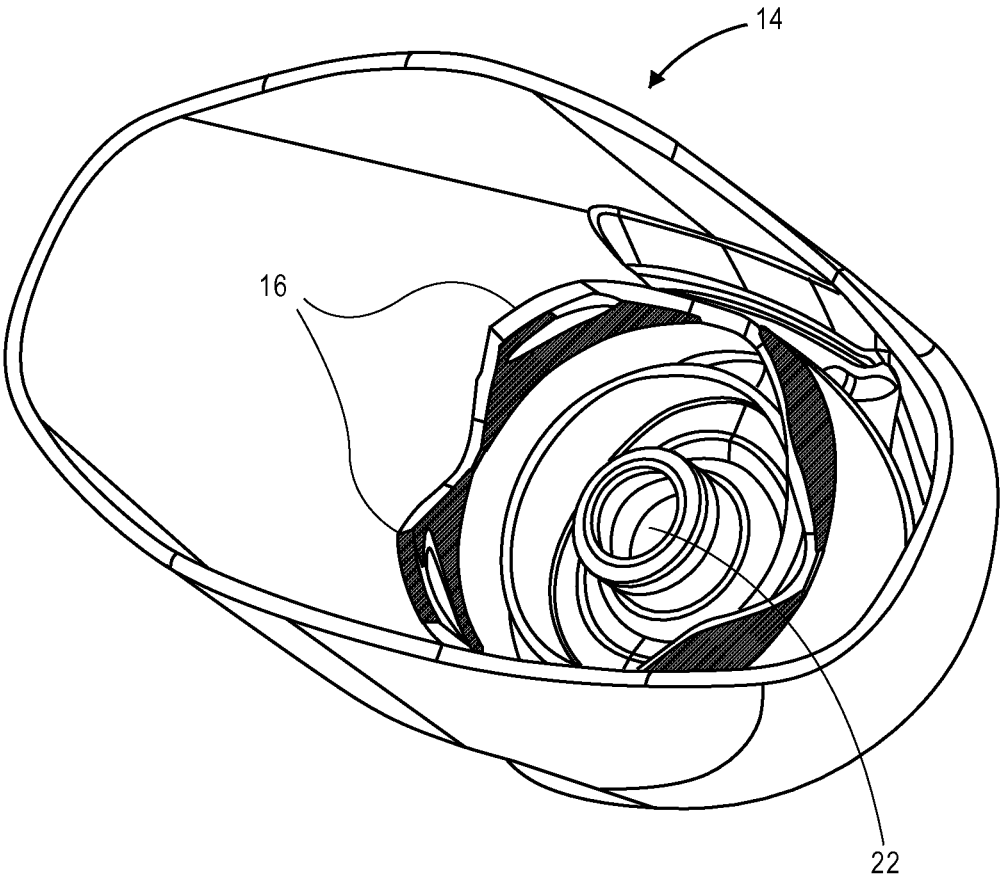
FIG. 2A (PRIOR ART)
FIG. 2A illustrates a perspective view of a conventional snap-on cap that can be used in conjunction with the bottle of FIG. 1.
Figure 2B:
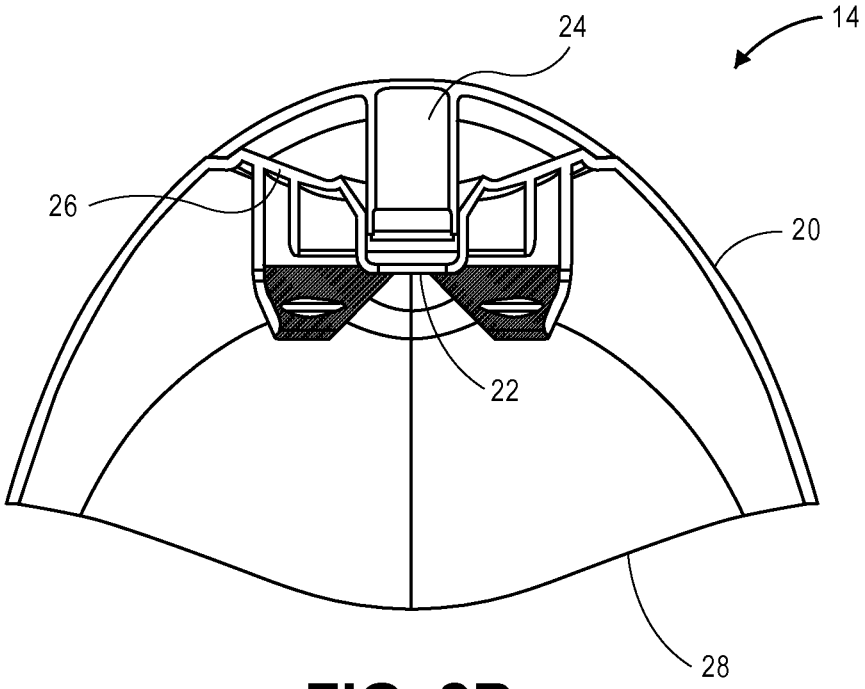
FIG. 2B (PRIOR ART)
FIG. 2B illustrates a cross sectional view of the conventional snap-on cap of FIG. 2A.
Figure 2C:
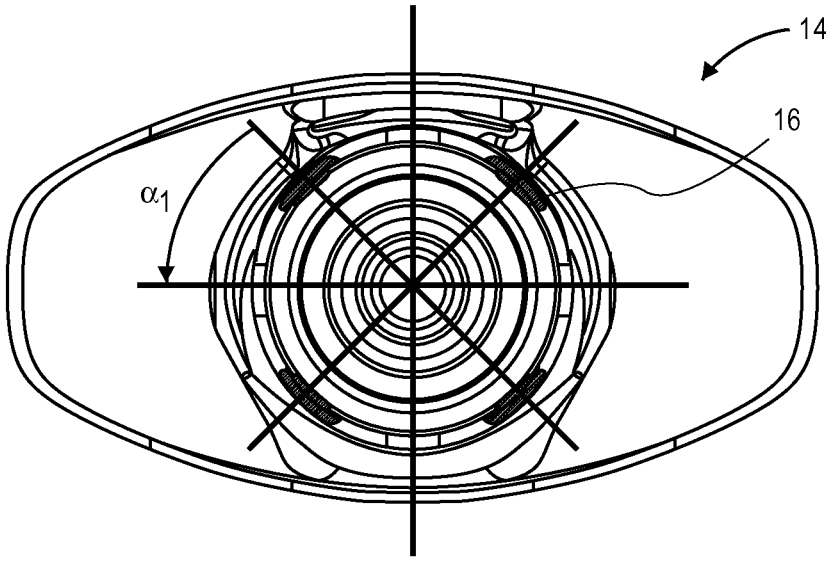
FIG. 2C (PRIOR ART)
FIG. 2C illustrates a top view of the inside of the conventional snap-on cap of FIGS. 2A and 2B.
Figure 3A:
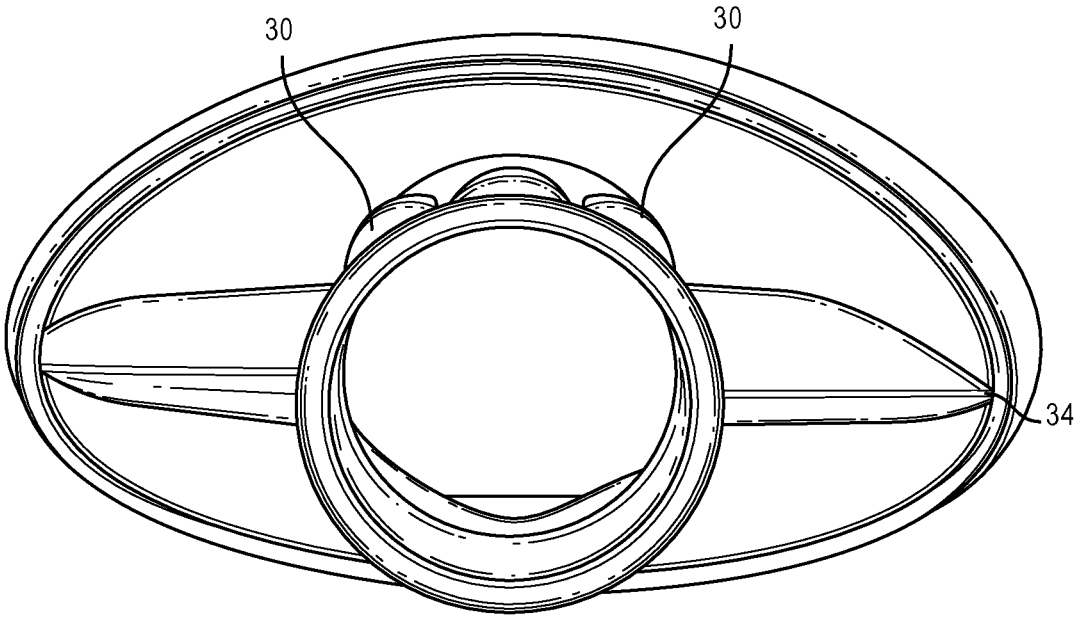
FIG. 3A (PRIOR ART)
FIGS. 3A and 3B illustrate a conventional easy-off bottle and cap design.
Figure 3B:
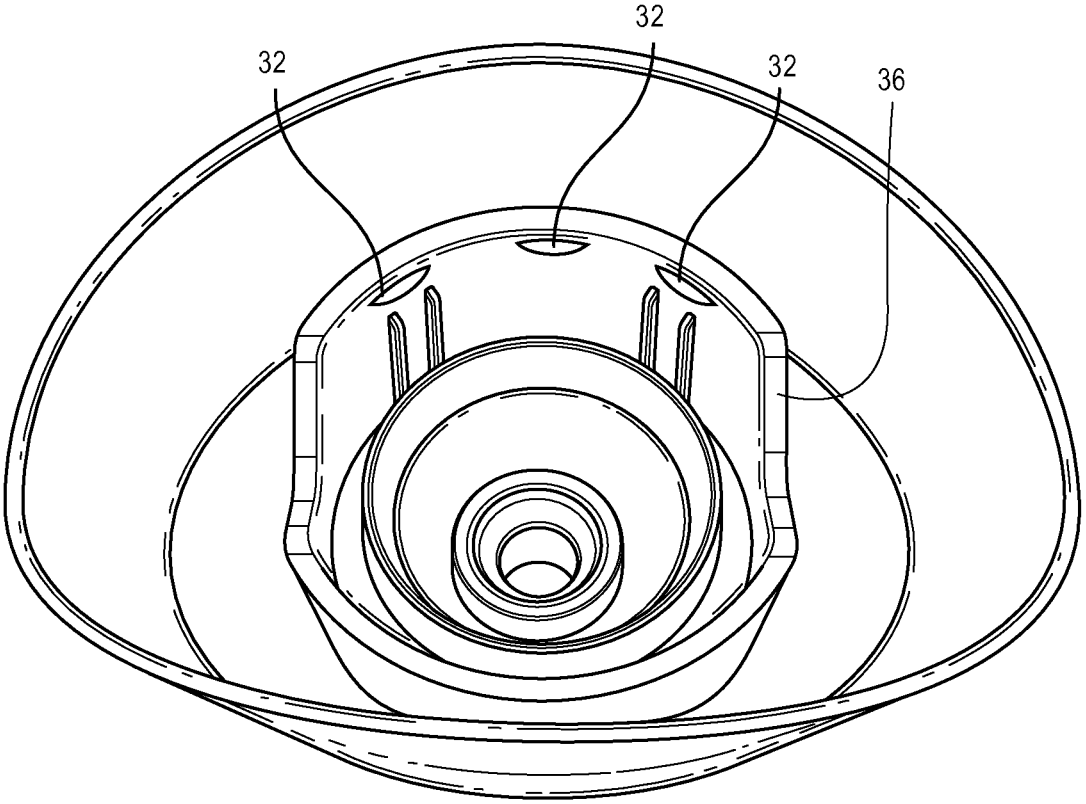
FIG. 3B (PRIOR ART)
Figure 6:
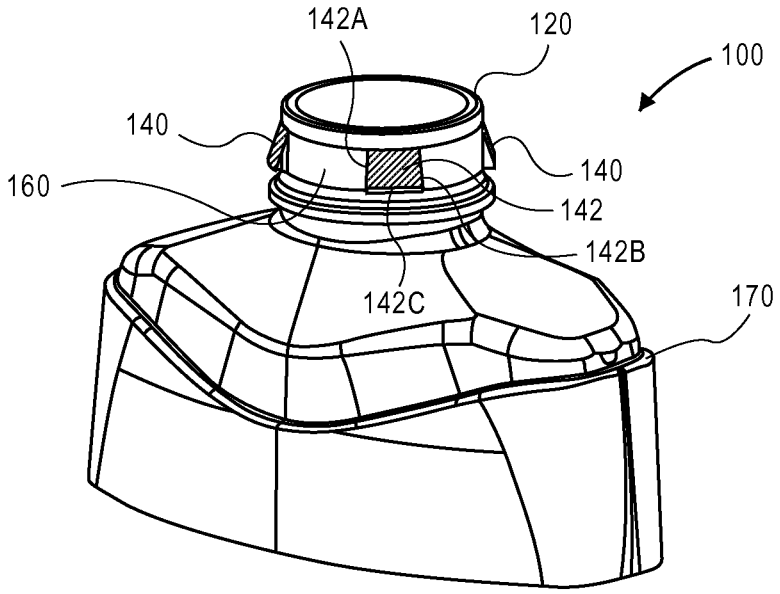
FIG. 6 illustrates a perspective view of an intermittent snap ring bottle, according to an embodiment of the present disclosure.

FIG. 6 illustrates a container 100 for use with the snap-on cap 14 of FIGS. 2A, 2B and 2C, or other such snap-on caps. Together, the container 100 and snap-on cap 14 form a container closure system, according to an embodiment of the present disclosure. The container 100 includes a neck 120 having an outer surface. The neck 12 includes a plurality of alternating snap ring segments 140 and snap ring voids 160 intermittently positioned around the outer surface.

The container closure system further comprises a cap 14, as described above. Referring to FIG. 2B, the cap comprises a skirt 20 with an orifice 22 positioned therein (as more clearly seen in FIG. 2A) and an orifice plug 24 for opening and closing the orifice 22. Orifice plug 24 is part of the flip cap that can be hinged opened by a consumer to pour liquid from the container 100 through the orifice 22. A cap deck 26 extends from the skirt and surrounds the orifice 22. The cap deck 26 comprises a plurality of snap prongs 16, as described above. Snap prongs 16 can be arranged so as to engage and disengage the plurality of snap ring segments 140 by rotating the cap 14 on the neck of the container 100. The plurality of snap prongs 16 are configured to hold the cap 14 in place on the container 100 when engaged with the snap ring segments 140 and to release the cap from the container when the snap prongs are disengaged from the snap ring segments 140.

When the cap is snapped onto the bottle, there are enough of the snap ring segments 140 to allow the snap prongs 16 to engage the snap ring segments 140 and hold the cap in place on the bottle. In various embodiments, the number of snap ring segments 140 may be less than, greater than, or equal to the number of snap prongs 16. In various embodiments, the force required to pull off the cap 14 in the axial direction of the neck remains approximately the same as the force required when a conventional full snap ring 12 is employed. In various embodiments, when the cap 14 is rotated, for example by 45°, such that the snap prongs 16 coincide radially with the voids 160, this results in a significantly or completely reduced obstruction or engagement between the snap prongs 16 and the snap ring segments 140, which in turn results in a reduced effort to remove the cap 14 compared to when the snap prongs 16 engage the snap ring segments 140.

In an embodiment, the snap ring segments 140 are beveled. For example, the plurality of snap ring segments 140 can each have a beveled top face 142. Top face 142 comprises a first side 142A that extends from the outer surface of the neck 120 to a distal end. A second side 142B is opposite the first side and also extends from the outer surface of the neck 120 to a distal end. A third side 142C extends between the distal end of the first side 142A and the distal end of the second side 142B. The first side 142A is substantially straight and intersects the third side 142C at a first angle, $\alpha_1$ (see FIG. 9). The second side 142B intersects the third side 142C at a second angle, $\alpha_2$. The angles $\alpha_1$ and $\alpha_2$ range, for example, from about 45° to about 135°, such as about 60° to about 120°, or about 80° to about 100°.

Figure 8:
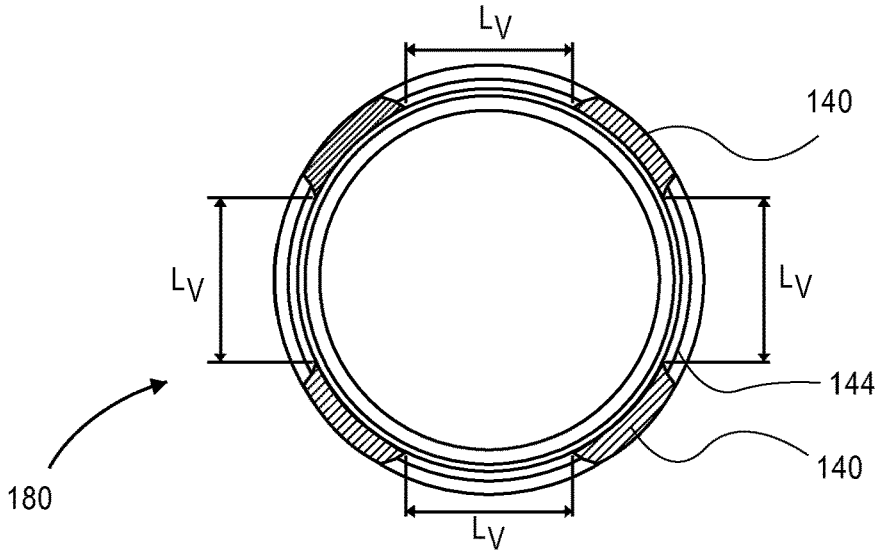
FIG. 8 illustrates an overhead view of a preform for fabricating an intermittent snap ring bottle using an injection stretch blow mold process, according to an embodiment of the present disclosure.
Figure 9:
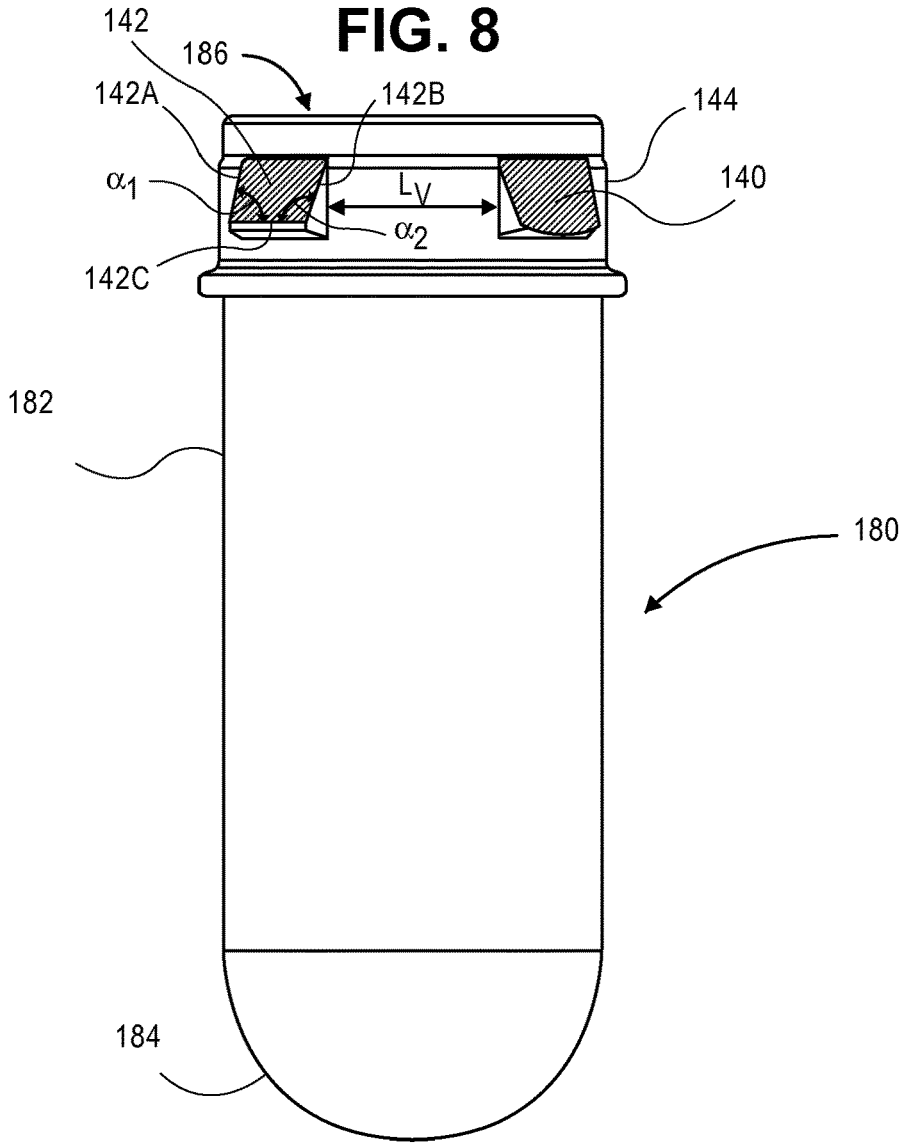
FIG. 9 illustrates a side view of a preform for fabricating an intermittent snap ring bottle using an injection stretch blow mold process, according to an embodiment of the present disclosure.

In an embodiment, the length of the circumference 144 at which snap ring voids 160 exist is 25% or more of the total length of the circumference 144, as shown in FIGS. 8 and 9. Thus, at least one quarter the length of the circumference is a void 160, such as about 25% to about 80%, or about 40% to about 75%, or 50% to about 75%, or about 55% to about 75%, or about 60% to about 75%. As also shown in FIGS. 8 and 9, each of the snap ring voids 160 extend a length, $L_v$, of the arc along the circumference 144. In an embodiment, $L_v$ is approximately equal for all the snap ring voids. The term "approximately equal" is defined herein to mean that none of the lengths vary by more than 20%. In an embodiment, none of the lengths vary by more than 10%, or more than 2%. In yet another embodiment, the lengths are equal.

The container 100 can include two or more snap ring segments 140. For example, there can be three, four or five snap ring segments 140. In the embodiment shown, there are four snap ring segments 140. The amount of rotation employed to release the cap will vary according to the chosen void/snap prong configuration. In an embodiment, the container 100 includes the same number of snap ring segments 140 as there are snap prongs 16 on the cap.

If the number of snap ring segments 140 is more than four, the difficulty of molding (assuming a basic 2-part mold) can increase owing to the increased occurrence of undercuts on a radially symmetrical implementation, and/or the reshaping of the geometry to work around this constraint. Furthermore, the greater the number of snap ring segments 140, the smaller the individual size of each of the individual snap ring segments 140, which may decrease the probability that the snap prongs 16 will remain engaged on the snap ring segments 140.

Figure 7:
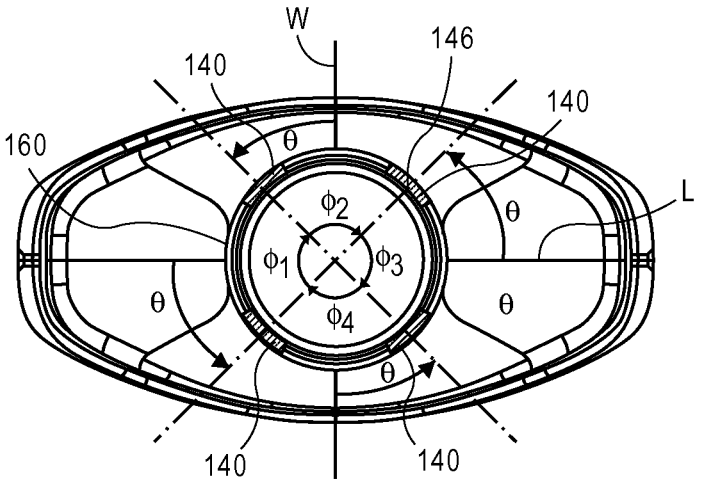
FIG. 7 illustrates an overhead view of the intermittent snap ring bottle of FIG. 6, according to an embodiment of the present disclosure.

As shown in FIG. 7, snap ring segments 140 can be positioned at regular increments around a circumference of the outer surface of the neck 120. The phrase "regular increments" is defined to mean that the angle between every pair of adjacent snap ring segments 140 around the neck 120, as measured from a midpoint 146 of each snap ring segment, is within the range of 55° to 125°. The midpoint 146 is taken to be the half way point between the two ends of each snap ring segment 140, as measured from the points where the ends of each segment intersect with the circumference of outer surface of neck 120. Thus, where four snap ring segments 140 are employed, the snap ring segments 140 can be positioned at alternating smaller and larger angles around a circumference of the outer surface and still be considered to be at regular increments (e.g., $\Phi_1$, and $\Phi_3$ range from 55° to less than 90° and $\Phi_2$ and $\Phi_4$ range from more than 90° to 125°). Such an arrangement would cover the embodiment of FIGS. 11A and 11B, which will be discussed in greater detail below. In an embodiment, the angle between every pair of adjacent snap ring segments 140 around the neck 120, as measured from a midpoint 146 of each snap ring segment, is within the range of 60° to 125° or 65° to 125°. In an embodiment, the increments are substantially identical, as shown in FIG. 7. For example, where four snap ring segments 140 are employed, the snap ring segments 140 can be positioned at 85° to 95° increments around a circumference of the outer surface (e.g., $\Phi_1$, $\Phi_2$, $\Phi_3$, $\Phi_4$=90°±5°). In another example where 5 snap ring segments are employed, the snap ring segments can be positioned at substantially identical increments of about 72°±5°. In another example where 3 snap ring segments are employed, the snap ring segments can be positioned at substantially identical increments of about 120°±5°.

Figure 13:
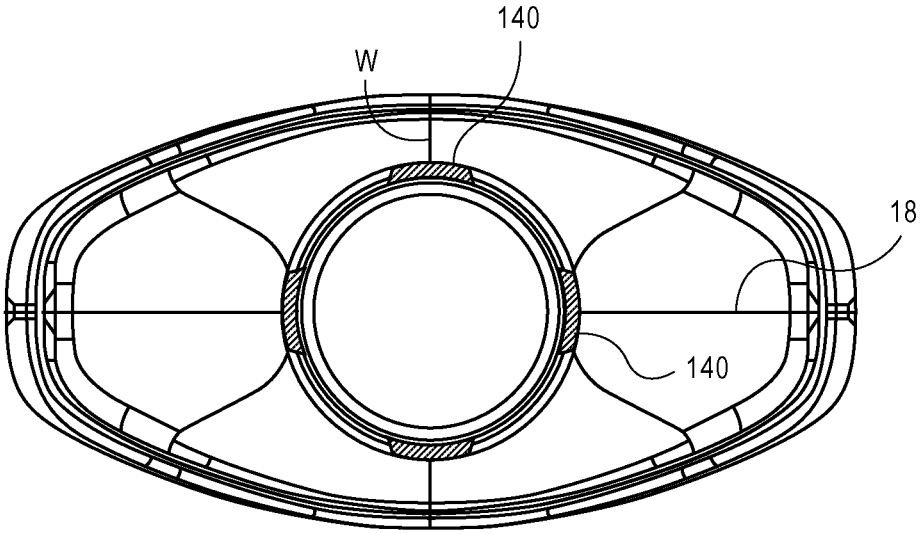
FIG. 13 illustrates an overhead view of an intermittent snap ring bottle, according to an embodiment of the present disclosure.

In an embodiment, a midpoint 146 of each of the four snap ring segments 140 is offset in a counter-clockwise direction from a major axis, L, and a minor axis, W, by a desired angle Θ, when viewed from the top, where Θ can range from 0 to about 90°, such as about 30° to 60°, or about 45°. In an alternative embodiment, the snap ring segments 140 are positioned on the major axis, L, and the minor axis, W, as shown in FIG. 13. The angles and offset can be modified depending on the number of snap ring segments 140. For example, in an embodiment where 3 snap ring segments are employed, the snap ring segments can be positioned at about 120° increments.

Figure 10:
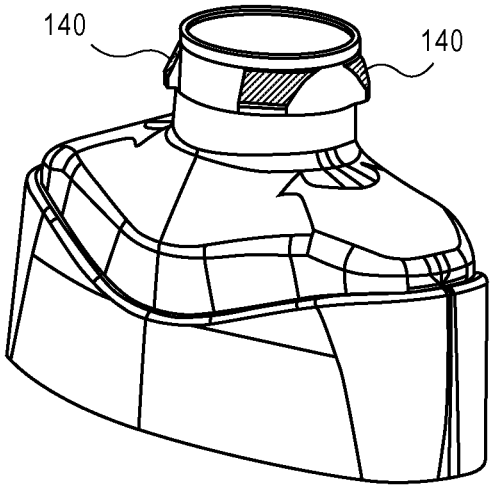
FIG. 10 illustrates a perspective view of a bottle, according to an embodiment of the present disclosure.

In an embodiment, the snap ring segments 140 form a radially symmetrical pattern on a circumference of the outer surface, as is shown, for example, in FIG. 7. Such a radially symmetrical design can provide ease of use for the consumer. In an alternative embodiment, as shown in FIGS. 10 and 11, the snap ring segments 140 form a radially asymmetrical pattern on a circumference of the outer surface. Such asymmetrical designs may be advantageous for various reasons, such as manufacturing considerations, weight savings and/or aesthetics, so long as the intended function is preserved.

Figure 5A:
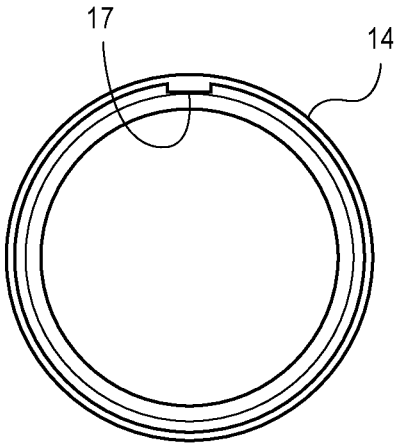
FIG. 5A (PRIOR ART)
FIG. 5A illustrates a perspective view of a conventional snap ring bottle.
Figure 5B:
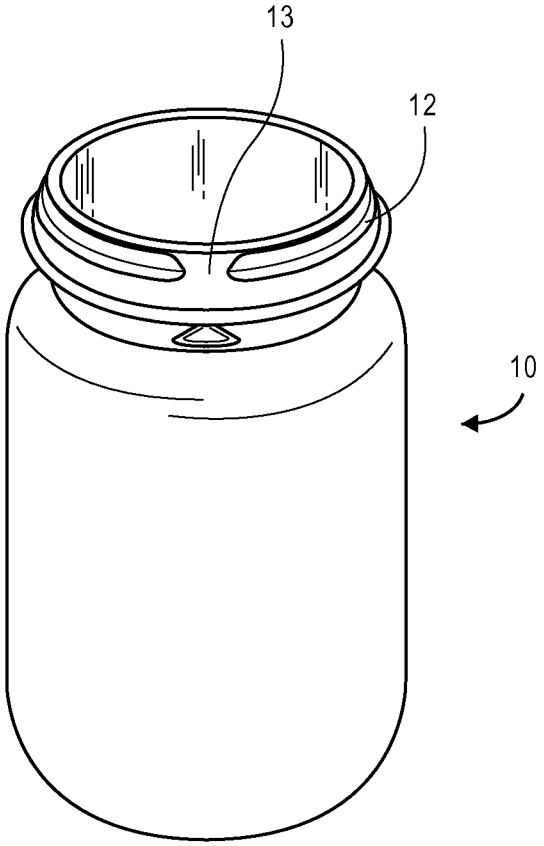
FIG. 5B (PRIOR ART)
FIG. 5B illustrates a perspective view of a conventional cap for the snap ring bottle of FIG. 5A.

Any suitable process can be employed to manufacture the container closure systems of the present disclosure. Examples include molding processes such as injection stretch blow molding and extrusion blow molding. Such processes are generally well known in the art. FIGS. 8 and 9 illustrate a preform 180 that can be employed in an injection stretch blow molding (ISBM) process, according to an embodiment of the present disclosure. The preform comprises a plastic tube 182 that is closed at end 184 and open at the opposite end 186. Any suitable type of plastic can be employed, such as polyethylene terephthalate ("PET"). The preform 180 can be injection molded with a part line that allows for radially symmetrical snap ring segments 140, as shown in FIGS. 8 and 9. Since the orientation of preforms is commonly random with respect to the resulting blown bottle, the snap ring segments 140 in the neck finish can be deliberately oriented to the bottle to fit a desired cap design. For example, the snap ring segments 140 can be aligned with an offset of 45° from the bottles major and minor axes in order for the invention to work with the above mentioned cap of FIG. 5.

Figure 11A:
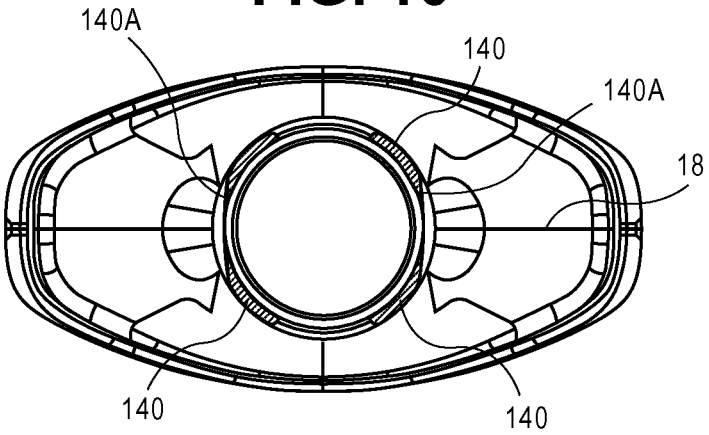
FIG. 11A illustrates an overhead view of the bottle of FIG. 10, according to an embodiment of the present disclosure.
Figure 11B:
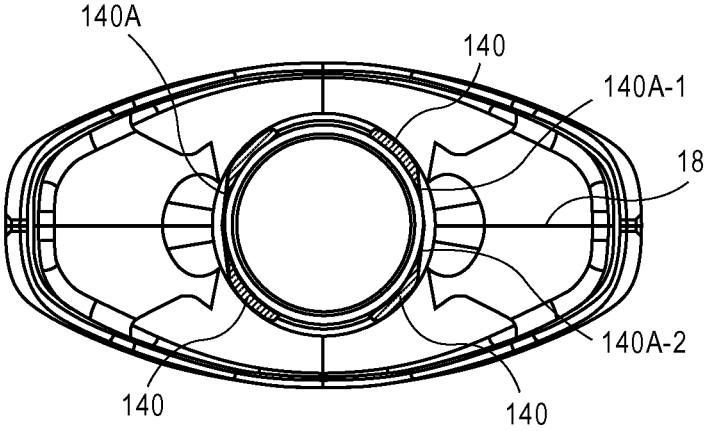
FIG. 11B illustrates an overhead view of a bottle, according to an embodiment of the present disclosure.
Figure 14:
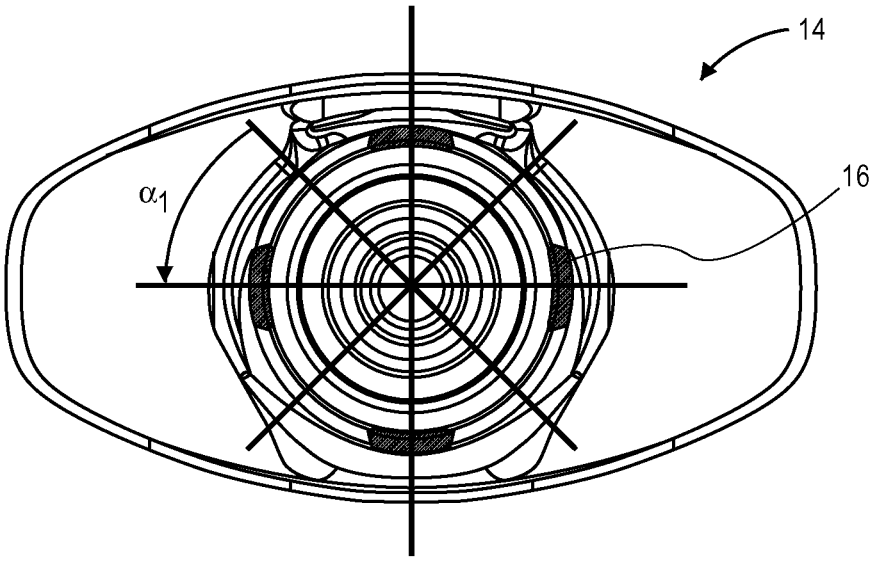
FIG. 14 shows a cap configured to fit the bottle of FIG. 14, according to an embodiment of the present disclosure.

For an extrusion blow molding (EBM) process where the neck finish is created in the blow molding process, modification of the snap ring segments 140 to a geometry that is non-radially symmetrical may be employed. For example, referring to FIGS. 11A and 11B, the snap ring segments 140 can be made with opposing surfaces 140A that are either perpendicular to, or slightly convex from perpendicular to, a part line 18 in order to avoid undercuts and provide any desired molding draft relief so as to allow the molds to be easily separated from the bottle at the completion of the molding process. FIG. 11A shows snap ring segments 140 made with opposing surfaces 140A that are slightly convex from perpendicular to the part line 18, where the surfaces 140A each form a single, continuous convex surface that is arced to eliminate the snap ring in the area about the part line 18 so as to allow release of the lid. FIG. 11B shows snap ring segments 140 made with opposing surfaces 140A that are also slightly convex from perpendicular to the part line 18, where the surfaces 140A each include two non-continuous surfaces, 140A-1 and 140A-2, that are symmetrical across the part line 18. The non-continuous surfaces 140A-1 and 140A-2 are configured to eliminate the snap ring in the area about the part line 18 so as to allow release of the lid. Alternatively, the cap's snap prongs and the snap ring segments on the container may be positioned to avoid an undercut in the EBM molding process. For example, referring to the container 200 of FIG. 13, the snap ring segments 140 can be positioned on the part line 18 and minor axis, W. The snap prongs 16 of the corresponding cap 210 can be oriented to engage the snap ring segments 140, as shown in FIG. 14, thus allowing for a radially symmetrical design for the EBM process.

Figure 4A:
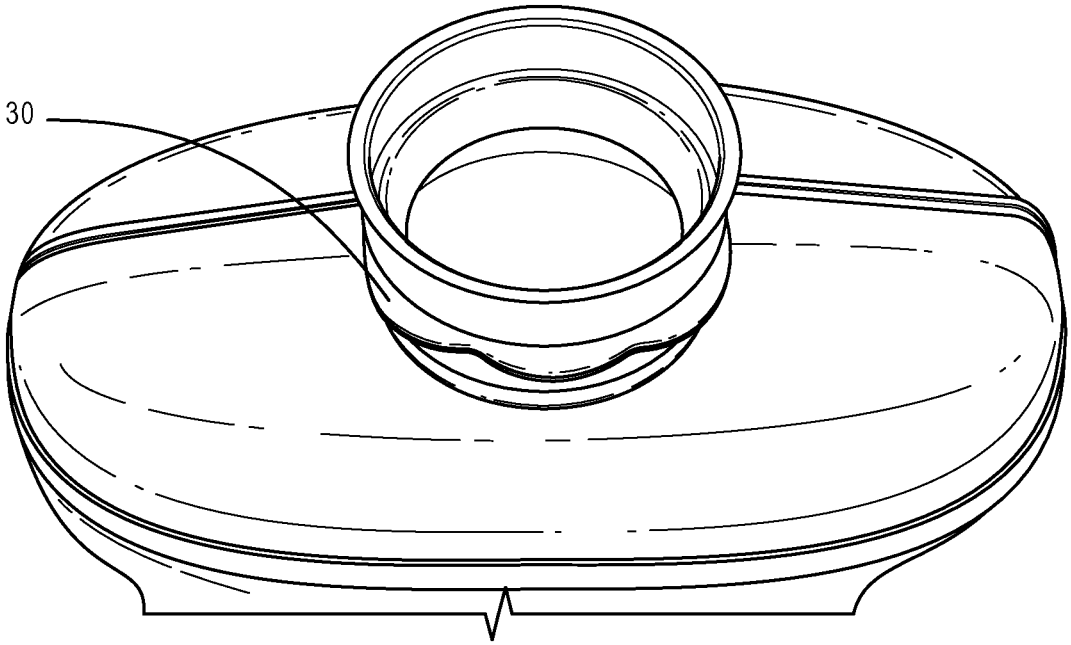
FIG. 4A (PRIOR ART)
FIGS. 4A and 4B illustrate a conventional bottle and cap design.
Figure 4B:
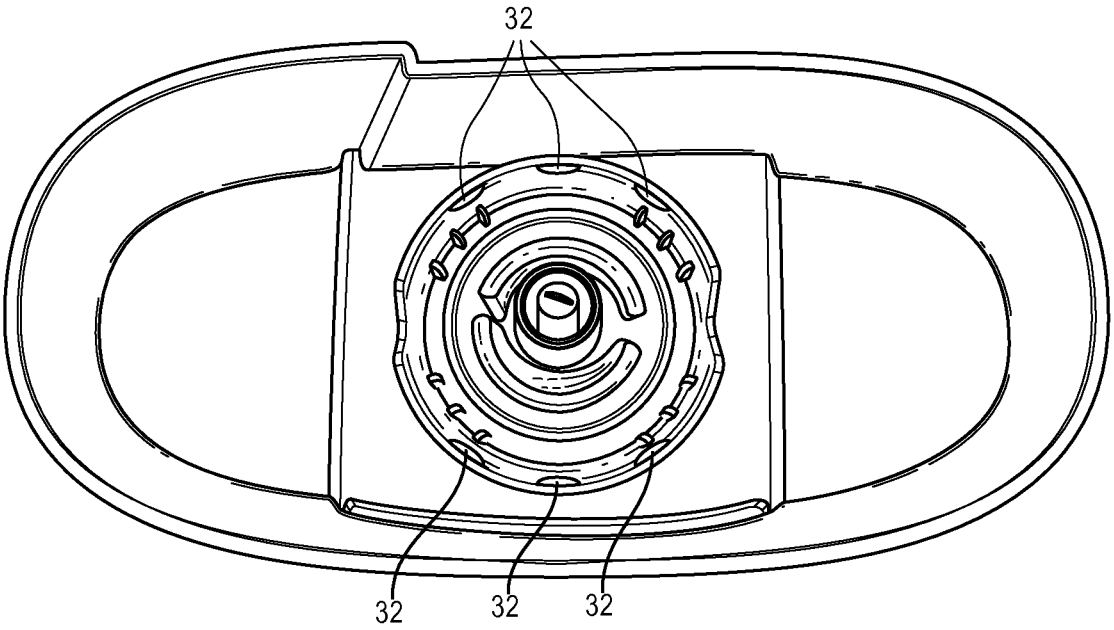
FIG. 4B (PRIOR ART)
Figure 12:
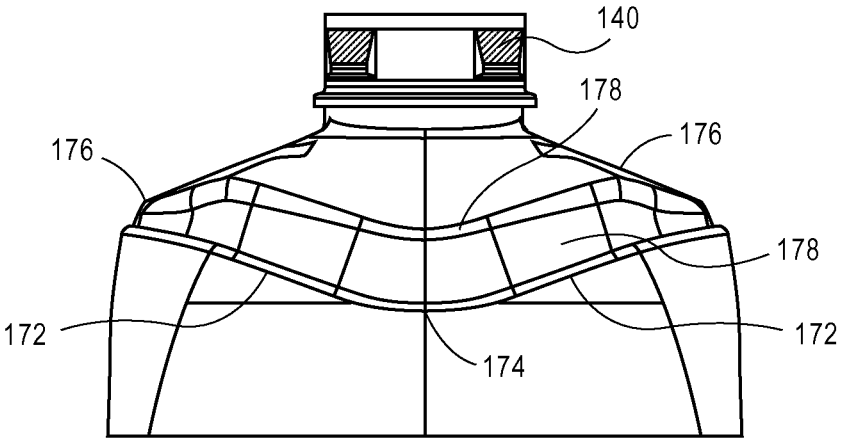
FIG. 12 illustrates a side view of the bottle of FIG. 10, according to an embodiment of the present disclosure.

Referring again to the embodiment of FIG. 4, the skirt 20 further comprises a wave shaped rim 28. As shown in FIG. 6, the corresponding container 100 comprises a recess 170 having a wave shape corresponding to the wave shaped rim 28. In an embodiment, the wave shape is a sinusoidal shape with inflection points 172 on each side of a minima 174, as is more clearly shown in FIG. 12. Such wave shapes in combination with the sloped shoulders 176 and sloped sides 178 above the recess 170 can allow for the twisting of the cap 14 about a radial axis of the neck to result in a cammed leverage action between the cap 14 and the container 100. The cammed leverage action results in a force being applied to the cap 14 tending to remove the cap from the container 100. In such embodiments, this can be exploited to simplify and ease the removal of the cap, as the consumer may be able to simply twist to remove the cap, rather than both twisting and pulling the cap.

What is claimed is:

1. A container closure system, comprising:

a container comprising a neck having an outer surface, the neck including a plurality of snap ring segments alternating with a plurality of snap ring voids positioned around a circumference of the outer surface, the length of the circumference at which snap ring voids exist being 25% or more of the total length of the circumference, wherein the plurality of snap ring segments are positioned at regular increments around a circumference of the outer surface, the increments being measured from the midpoint of each of the snap ring segments on the circumference of the outer surface; and a cap comprising a skirt with an orifice positioned therein, a plug assembly for blocking and unblocking the orifice, and a base extending from the skirt and surrounding the orifice, the base comprising a plurality of snap prongs arranged so as to engage and disengage the plurality of snap ring segments when the cap is rotated on the neck of the container, the plurality of snap prongs configured to hold the cap on the container when engaged with the plurality of snap ring segments and to release the cap from the container when the plurality of snap prongs are disengaged from the plurality of snap ring segments;

wherein the plurality of snap ring segments comprise a first snap ring segment positioned adjacent to a second snap ring segment, a first portion of the outer surface extending between the first and second snap ring segments; and a third snap ring segment positioned adjacent to a fourth snap ring segment, a second portion of the outer surface extending between the third and fourth snap ring segments, wherein a side of the first snap ring segment, a side of the second snap ring segment and the first portion of the outer surface form a first planar surface, and wherein a side of the third snap ring segment, a side of the fourth snap ring segment and the second portion of the outer surface form a second planar surface, the first planar surface opposing the second planar surface.

2. The container closure system of claim 1, wherein each of the snap ring voids extend a length of an arc along the circumference, the length of all of the snap ring voids being approximately equal.

3. The container closure system of claim 1, wherein the plurality of snap ring segments are positioned at 65° to 125° increments around the circumference of the outer surface, the increments being measured from the midpoint of each of the snap ring segments on the circumference of the outer surface.

4. The container closure system of claim 1, wherein the plurality of snap ring segments form a radially asymmetrical pattern on a circumference of the outer surface.

5. The container closure system of claim 1, wherein the number of snap ring segments is equal to the number of snap prongs.

6. The container closure system of claim 1, wherein the plurality of snap ring segments each have a beveled top face that comprises a first side that extends from the outer surface to a distal end, a second side that is opposite the first side and extends from the outer surface to a distal end, and a third side that extends between the distal end of the first side and the distal end of the second side, the first side intersecting the third side at a first angle and the second side intersecting the third side at a second angle.

7. The container closure system of claim 6, wherein the first angle and the second angle range from about 45° to about 135°.

8. The container closure system of claim 1, wherein the skirt further comprises a wave shaped rim and the container comprises a recess having a wave shape corresponding to the wave shaped rim, so that twisting the cap about a radial axis of the neck results in a cammed leverage action between the cap and the container that applies a force to the cap tending to remove the cap from the container.

9. A preform for use in a blow mold process, the preform comprising:

a plastic tube comprising a neck having an outer surface, the neck including a plurality of snap ring segments alternating with a plurality of snap ring voids positioned around the outer surface, the length of a circumference at which snap ring voids exist being 25% or more of the total length of a circumference, wherein the plurality of snap ring segments are positioned at regular increments around the circumference of the outer surface, the increments being measured from the midpoint of each of the snap ring segments on the circumference of the outer surface;

wherein the plurality of snap ring segments comprise a first snap ring segment positioned adjacent to a second snap ring segment, a first portion of the outer surface extending between the first and second snap ring segments; and a third snap ring segment positioned adjacent to a fourth snap ring segment, a second portion of the outer surface extending between the third and fourth snap ring segments, wherein a side of the first snap ring segment, a side of the second snap ring segment and the first portion of the outer surface form a first planar surface, and wherein a side of the third snap ring segment, a side of the fourth snap ring segment and the second portion of the outer surface form a second planar surface, the first planar surface opposing the second planar surface.

10. The preform of claim 9, wherein the plurality of snap ring segments are positioned at 90° increments around the circumference of the outer surface, the increments being measured from the midpoint of each of the snap ring segments on the circumference of the outer surface.

11. The preform of claim 9, wherein the plurality of snap ring segments form a radially asymmetrical pattern on a circumference of the outer surface.

12. A container closure system, comprising:

a container comprising a neck having an outer surface, the neck including a plurality of snap ring segments alternating with a plurality of snap ring voids positioned around a circumference of the outer surface, the length of the circumference at which snap ring voids exist being about 60 to about 75% of the total length of the circumference; and a cap comprising a skirt with an orifice positioned therein, a plug assembly for blocking and unblocking the orifice, and a base extending from the skirt and surrounding the orifice, the base comprising a plurality of snap prongs arranged so as to engage and disengage the plurality of snap ring segments when the cap is rotated on the neck of the container, the plurality of snap prongs configured to hold the cap on the container when engaged with the plurality of snap ring segments and to release the cap from the container when the plurality of snap prongs are disengaged from the plurality of snap ring segments;

wherein the plurality of snap ring segments comprise a first snap ring segment positioned adjacent to a second snap ring segment, a first portion of the outer surface extending between the first and second snap ring segments; and a third snap ring segment positioned adjacent to a fourth snap ring segment, a second portion of the outer surface extending between the third and fourth snap ring segments, wherein a side of the first snap ring segment, a side of the second snap ring segment and the first portion of the outer surface form a first planar surface, and wherein a side of the third snap ring segment, a side of the fourth snap ring segment and the second portion of the outer surface form a second planar surface, the first planar surface opposing the second planar surface.

* * * * *